United States Patent [19]

Unger et al.

[11] 4,147,453

[45] Apr. 3, 1979

[54] METHOD OF, AND APPARATUS FOR, DRIVING AND LINING TUNNELS

[75] Inventors: Eberhart Unger, Luneh; Hans Jütte, Dortmund-Brachten; Dieter Stuckmann, Selm, all of Fed. Rep. of Germany

[73] Assignee: Gewerkschaft Eisenhutte Westfalia, Lunen, Fed. Rep. of Germany

[21] Appl. No.: 877,957

[22] Filed: Feb. 15, 1978

[30] Foreign Application Priority Data

Feb. 15, 1977 [DE] Fed. Rep. of Germany ..... 2706244
Jun. 8, 1977 [DE] Fed. Rep. of Germany ..... 2725827

[51] Int. Cl.[2] ..... E21D 11/00
[52] U.S. Cl. ..... 405/141
[58] Field of Search ..... 61/85, 84, 63, 42

[56] References Cited

U.S. PATENT DOCUMENTS

| | | | |
|---|---|---|---|
| 3,372,553 | 3/1968 | Samoilou | 61/85 |
| 3,657,897 | 4/1972 | Krismer et al. | 61/85 |
| 4,063,424 | 12/1977 | Luttle et al. | 61/85 |

*Primary Examiner*—Jacob Shapiro
*Attorney, Agent, or Firm*—Thompson, Birch, Gauthier & Samuels

[57] ABSTRACT

Apparatus for driving and lining tunnels utilizes a knife shield for driving a tunnel and shuttering for forming a concrete lining behind the knife shield. The shuttering is constituted by a plurality of shuttering elements, each of which is connected to, and inwardly off-set from, a respective knife. The shuttering elements are, therefore, advanced together with their knives and concrete is forced into the space between a shuttering element and the tunnel wall as that element is advanced.

25 Claims, 10 Drawing Figures

METHOD OF, AND APPARATUS FOR, DRIVING AND LINING TUNNELS

BACKGROUND TO THE INVENTION

This invention relates to a method of, and apparatus for driving and lining tunnels. The term "tunnel" or "tunnels" used throughout this specification is intended to include galleries, underground roadways, trenches and similar elongate excavations.

In order to drive a tunnel, it is known to use a knife shield, that is to say a drive shield having a plurality of elongate planks (knives) mounted side-by-side on a support frame, the knives being advanceable, either singly or in groups, relative to the frame for driving the tunnel. Where a tunnel formed by such a knife shield is to be provided with a concrete lining, the knife shield is provided with shuttering at its rear, which enables the concreting work to be effected immediately behind the knife shield and simultaneously with the advance of the tunnel. One known apparatus for driving and lining tunnels utilises a knife shield whose knives are provided with tail extensions which together form an outer shuttering (see DT-OS 2522029). Inner shuttering is constitute by a tubular former which is coupled, via hydraulic rams, to the support frame of the knife shield, so that it can be advanced in accordance with the progress of the concreting work, the support frame acting as an abutment for this advance. In order to close the end of the annular space between the outer and inner shuttering. an end shuttering is provided, this end shuttering also being connected to the support frame in such a way that it can be advanced as the concreting proceeds.

With this apparatus, the tunnelling and the concreting (lining) can be rendered largely independent of each other. Unfortunately, such apparatus is both complicated and expensive. Moreover, when the tail extensions of the knives forming the outer shuttering are advanced, gaps are formed between the walls of the tunnel and the concrete lining introduced which may lead to undesirable subsidence.

The aim of the invention is to provide a method of, and apparatus for driving and lining tunnels, which substantially reduces the risk of subsidence, and which enables the concrete lining to be introduced immediately behind the tunnel drive shield so that the exposed tunnel wall can be rendered safe within a very short time.

SUMMARY OF THE INVENTION

The present invention provides a method of driving and lining tunnels, the method comprising the steps of driving a tunnel by means of a drive shield, and forming a concrete lining in the tunnel behind the drive shield, the lining being formed in sections along the tunnel, wherein each lining section is formed by introducing concrete into an annular spaced formed between a shuttering and the tunnel wall, the shuttering being constituted by a plurality of elongate shuttering elements, each of which may be advanced independently of the others.

Preferably, the drive shield is a knife shield, each shuttering element being connected to a respective knife of the knife shield for conjoint advance movement therewith, and wherein the advance of a shuttering element is accompanied by the step of forcing concrete into the space between that shuttering element and the tunnel wall.

In this method, therefore, a special outer shuttering is dispensed with, so that the concrete lining extends right up to the tunnel wall. As there are no knife tail extensions forming an outer shuttering which have to be advanced as the knives of the knife shield are advanced, no gaps can form between the concrete lining and the tunnel wall. Consequently, the risk of subsidence is greatly reduced. At the same time, this method permits the concrete lining to be introduced immediately behind the knife shield, in the course of the tunnelling work, and thus secure the tunnel wall behind the knife shield within a very short time of its excavation. This applies particularly when the concrete is forced under pressure into the space between a shuttering element and the tunnel wall, so that such a space is at all times filled with concrete under pressure. To enable a concrete lining with the required strength to be obtained as rapidly as possible, it is advisable to use a concrete that sets quickly.

Advantageously, the concrete is introduced into each said space through the respective knife of the knife shield, and reinforcement elements are introduced into each said space through the respective knife.

Preferably, each shuttering element is detachably connected to its knife, and wherein after each lining section is completed, the shuttering elements are detached from their knives, the knives are advanced slightly to expose the annular end surface of that lining section, packing is positioned around said annular end surface, and the shuttering elements are re-attached to their knives. Advantageously, a groove is formed in said annular end surface and the packing is positioned in this groove. These packings help to key together adjacent lining sections.

The invention also provides apparatus for driving and lining tunnels, the apparatus comprising a drive shield for driving the tunnel, and a shuttering positioned behind the drive shield for supporting a tunnel lining section whilst the concrete forming that section sets, the shuttering being inwardly off-set, in use, from the tunnel wall to define an annular space, wherein the shuttering is constituted by a plurality of elongate shuttering elements each of which may be advanced independently of the others.

Preferably, the drive shield is a knife shield having a plurality of knives mounted on a support frame, each of the knives being advanceable relative to the support frame by means of a respective hydraulic advance ram, and wherein each shuttering element is connected to a respective knife for conjoint advance movement therewith.

Advantageously, an annular end shuttering is provided for closing the front end of said annular space. Preferably, the annular end shuttering is constituted by the rear end faces of the knives.

Each shuttering may be detachably and pivotally connected to its respective knife. Each shuttering element may be connected to its respective knife in such a way that the distance of that shuttering element from the tunnel wall is adjustable. Also each shuttering element may be connected to its respective knife by means of a connecting plate.

In a preferred embodiment, each of the knives is provided with a rail extension which extends rearwardly of the point of connection with the respective shuttering element, the tail extensions resting, in use, against the tunnel wall and being supported by a follow-up shield. This enables the concrete lining to be introduced immediately behind the knife shield, in the course of the tunnelling work, the critical zone between the rear end of the knife shield and the concrete lining already introduced being secured by the tail extensions and the follow-up shield supporting them. The tunnelling operation and the concreting operation can then be effected independently of each other, thanks to the overlap between the tail extensions and the follow-up shield. Preferably, the maximum distance of this overlap is greater than the length of the working stroke the hydraulic advance rams, so that this critical zone is always secured by at least one of these bodies.

Advantageously, the end shuttering is provided on the follow-up shield. This enables the concrete lining to be produced in successive lining sections and packing to be introduced between each pair of adjacent sections in the known manner. The concrete can be introduced into the space between the shuttering elements and the tunnel wall via at least one pipe terminating at a port in the end shuttering.

With the embodiment having tail extensions and the follow-up shield, it is preferable for each shuttering element to be connected to its respective knife by means of a link, the link being joined to the shuttering element and to the knife by respective ball-and-socket joints. This ensures that the shuttering and the knife shield can be adjusted in relation to each other, so that the shuttering can be accurately aligned with respect to the axis of the tunnel even if the knife shield moves out of place. Advantageously, means are provided for aligning the shuttering. Preferably, said alignment means is constituted by a plurality of radially directed hydraulic rams each of which is positioned between a respective shuttering element and the follow-up shield.

Preferably, the end shuttering is rigidly connected to the follow-up shield, and the follow-up shield is coupled to the support frame of the knife shield by means of hydraulic rams. In this case, the support frame may have frame sections which support the knives and the follow-up shield respectively.

The length of the tail extensions is preferably about equal to the axial length of the follow-up shield, and each of the shuttering elements has a length considerably greater than its respective tail extension.

Preferably, each of the shuttering elements is constituted by two elongate members pivotally joined together. This formation, together with the detachable coupling of the shuttering elements with their knives enables the shuttering to be opened up for the purpose of introducing a packing.

Advantageously, the end shuttering is constituted by two rings, one of which is fixed to the follow-up shield and the other of which is radially adjustable.

Preferably, the follow-up shield is a smooth-walled sheet metal structure. The tail extensions which rest slidably on the follow-up shield are likewise made with smooth walls, in a manner known per se.

The apparatus to which the invention relates can also be used for driving tunnels, roads, etc. in stable rock. In such cases, the individual knives need not necessarily be provided with cutting edges on their front ends.

BRIEF DESCRIPTION OF THE DRAWINGS

Two forms of apparatus for driving and lining tunnels, and constructed in accordance with the invention, will now be described, by way of example, with reference to the accompanying drawings, in which.

DESCRIPTION OF PREFERRED EMBODIMENTS

Figure 1:
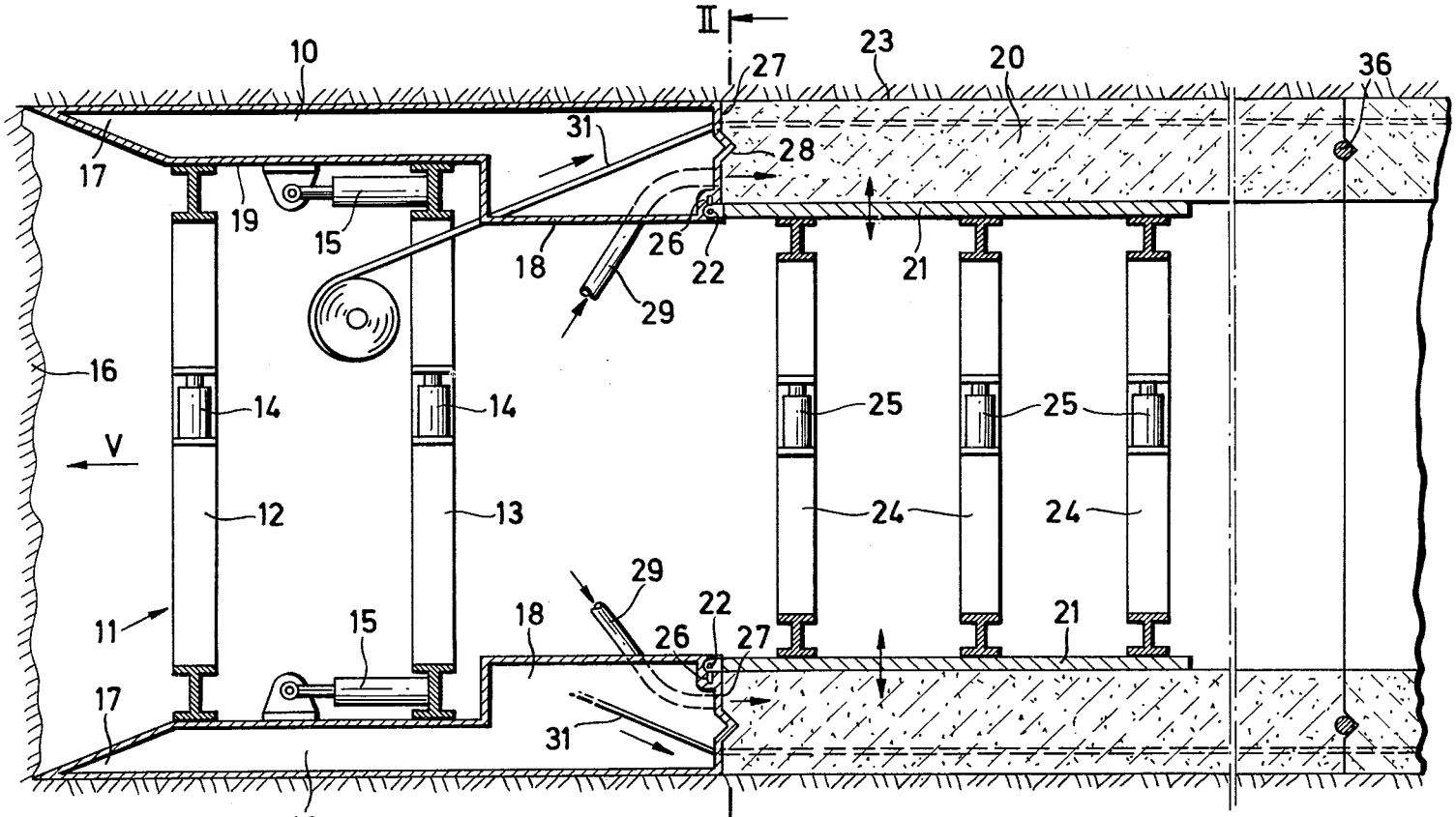
FIG. 1 a longitudinal cross-section through the first form of apparatus.

Referring to the drawings, FIG. 1 shows a tunnel driving and lining apparatus which has, at its front end, a knife shield. This knife shield is comprised of a circular array of knives 10 which together form a cylindrical shield, and each of which is displaceably supported on a common support frame 11. The support frame 11 consists of two frame sections 12 and 13 which are rigidly joined together by means of longitudinal and diagonal struts (not shown). The two frame sections 12 and 13 are constructed as expanding frames and can be expanded in the radial direction by means of hydraulic rams 14.

Each of the knives 10 is provided with a doubleacting hydraulic ram 15 which is interposed between that knife and the rear frame section 13. The rams 15, therefore, enable the knives 10 to be advanced, either individually or in groups, in the direction V, that is to say towards the working face 16. During this advance process, cutting portions 17 formed at the front ends of the knives 10 penetrate the face 16 so as to drive the tunnel. When a knife, 10 or group of knives, is advanced, the support frame 11 forms an abutment for the relevant ram or rams. The support frame itself is held stationary owing to the frictional contact between the remaining knives and the surrounding earth. As soon as all the knives 10 have been advanced by a distance corresponding to the stroke of the rams 15, the support frame 11 can be advanced by subjecting the rams 15 to pressure in the opposite direction. During this process, the frictional contact between the knives 10 and the surrounding earth forms an abutment for the rams 15.

Each of the knives 10 is provided, at its rear, with a box-shaped hollow portion 18 whose radial dimension is greater than that of the main portion of that knife, and whose length is greater than the stroke of the rams 15. Thus, the box-shaped portions 18 of the knives 10 project radially inwards beyond the internal cylindrical surface 19 defined by the knives. The radial dimension of each of the hollow portions 18 is somewhat greater than the thickness of the concrete lining 20 to be introduced behind the knife shield.

Each box-shaped hollow portion 18 is connected, via a pivot joint 22, to a shuttering element 21. The radial distance of the joints 22 from the tunnel wall 23 is approximately equal to the thickness of the concrete lining 20 to be introduced. The shuttering elements 21 thus form tail extensions of the knives 10 and combine to form a cylindrical inner shuttering for the introduction of the concrete lining. The shuttering elements 21 are supported by props 24, each of which is constituted by an annular frame which can be expanded radially by means of a hydraulic ram 25. The pivot joints 22 formed between the shuttering elements 21 and their knives 10 are constituted by pin-and-slot connections 26, which permit the elements 21 to move radially with respect to their knives 20 to a limited extent. By varying the expansion of the props 24, therefore, the shuttering elements 21 can be accurately aligned in respect of the direction which the tunnel is required to take. Moreover, the radial displaceability of the pivot joints 22 enables the thickness of the concrete lining 20 to be adjusted.

Figure 4:
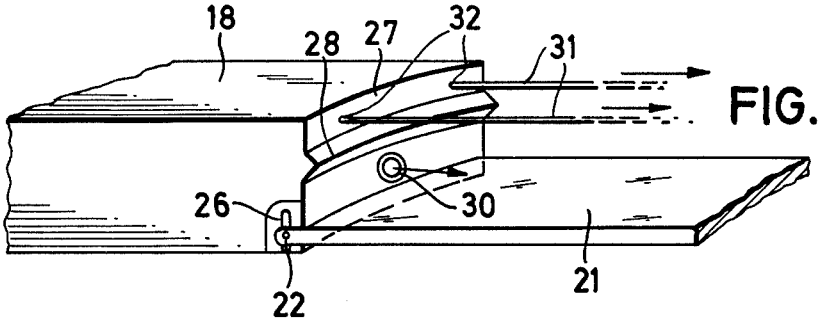
FIG. 4 a perspective view of part of a knife of the knife shield.

The rear end surfaces 27 of the box-shaped hollow portions 18 of the knives 10 combine to form an annular end shuttering element and close the annular space between the tunnel wall 23 and the shuttering elements 21. Each of the surfaces 27 is provided with a V-shaped projection 28 (see in particular FIG. 4) whose function will be explained below. The concrete is introduced into the annular space via the bore-shaped hollow portions 18, the concrete being fed in through pipes 29 and inlet ports 30 in the surfaces 27 (see FIG. 4). Preferably, a quick-setting concrete is used. Reinforcement elements 31 are also introduced into the annular space through the portions 18, suitable inlet apertures 32 being provided in the end surfaces 27 for this purpose.

In FIG. 1 the concrete lining 20 is completed up to the end shuttering 27. If an individual knife 10 is now advanced in the direction V, by means of its ram 15, its shuttering element 21 will be carried along with it, thereby opening up a corresponding space adjacent to the tunnel wall 23, the length of this space being equal to the working stroke of the ram and its width being equal to that of the knife 10. As shown in particular in FIG. 2, the shuttering elements 21 are provided along their longitudinal edges with flanges 33 which overlap one another to form a continuous shuttering. As an alternative to the overlapping flanges 33, however special packing elements can be provided on the longitudinal edges of the elements 21. While a given knife 10 is being advanced, concrete is forced through the corresponding pipe 29 into the space opened up by this advance, preferably in such a way that this space is immediately filled with concrete, whereby the pressure inside this space acts on the end surface 27 thus assisting the advance of the knife. By advancing the individual knives 10 forwards in succession, therefore, an annular concrete lining can be produced in successive concreting sections, the operation of forcing in the concrete being accompanied by the introduction of the reinforcement elements 31.

Figure 2:
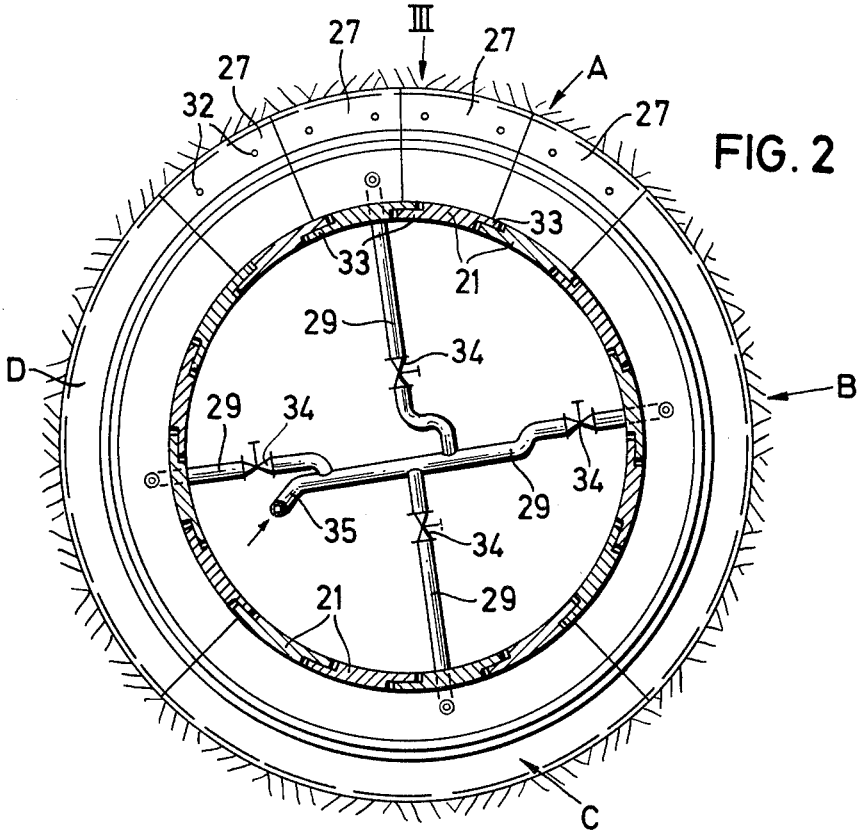
FIG. 2 a cross-section taken on the line II–II of FIG. 1.

The process described above can be carried out in the same manner if a number of knives 10 are advanced simultaneously. A modified form of apparatus suitable from this point of view is illustrated in FIG. 2. In this case, the annular space between the shuttering elements 21 and the tunnel wall 23 is subdivided longitudinally into four segments A, B, C and D, each segment being formed by a number of adjacent shuttering elements 21 and their associated end surfaces 27. A separate concrete feed pipe 29, provided with a respective shut-off valve 34, is associated with each segment A, B, C and D. The pipes 29 are connected to a common pipe 35 leading to a pump (not shown) for the supply of the concrete. Concrete, therefore, can be introduced through the feed pipes 29 into any one, as desired, of the four segments A, B, C and D, during which process the corresponding shut-off valve 34 is open. Each feed pipe 29 terminates at an inlet port formed in the end surface 27 of one of the knives forming the respective segment A, B, C and D. The knives 10 of each segment A, B, C and D can be advanced either individually or in groups. Needless to say, the spaces associated with all the knives of a given segment A, B, C and D are connected with one another, so that concrete fed via one knife 10 can flow into the space which opens up when another knife of that segment is advanced.

Figure 3:
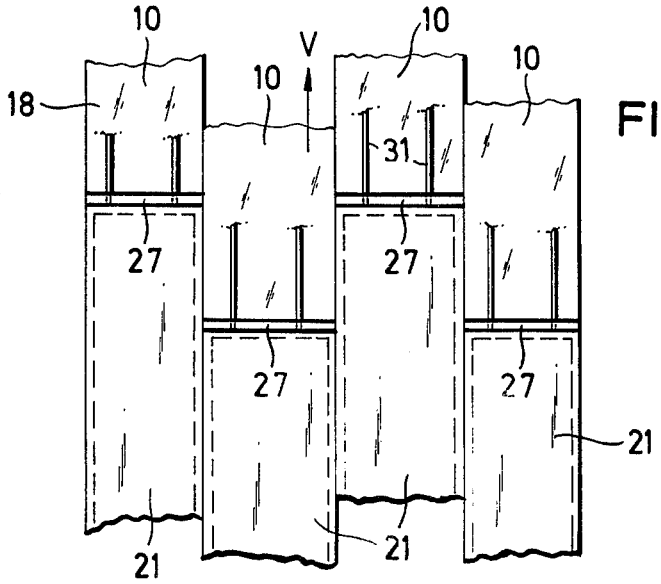
FIG. 3 a schematic plan view of a number of adjacent knives of the knife shield forming part of the apparatus of FIGS. 1 and 2.

FIG. 2 only shows the knives 10 of the segment A, and FIG. 3 is a plan view of the four knives of this segment, two of these knives having already been advanced. Consequently, the end surfaces 27 of these advanced knives 10 are situated farther forwards in the direction V, by a distance corresponding to the working stroke of the rams 15, than the end surfaces 27 of the other knives of this segment. The operation of feeding the concrete into the spaces associated with the knives 10 which are adjacent to the knife provided with the feed pipe 29 can be carried out, for example, by providing between these knives pipe connections leading to the individual spaces. Alternatively however, the common supply pipe 29 can be connected, as desired, with each of the knives in that segment.

Figure 5:
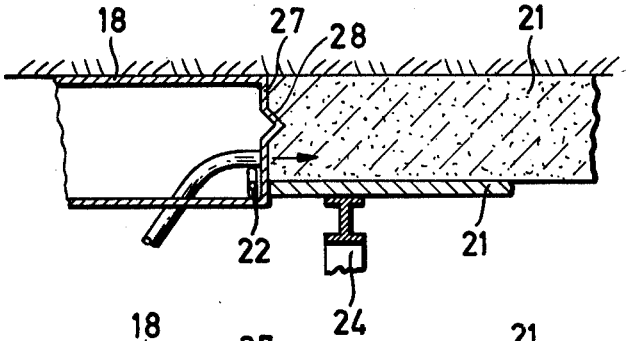
FIGS. 5–8 are each a partial longitudinal cross-section through the rear end of a knife, and show the operations performed in the introduction of a packing between successive concrete sections.
Figure 6:
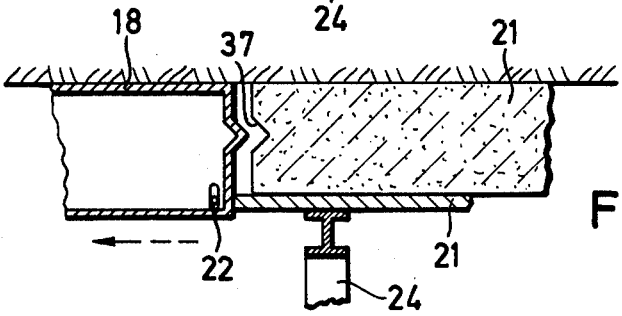
Figure 7:
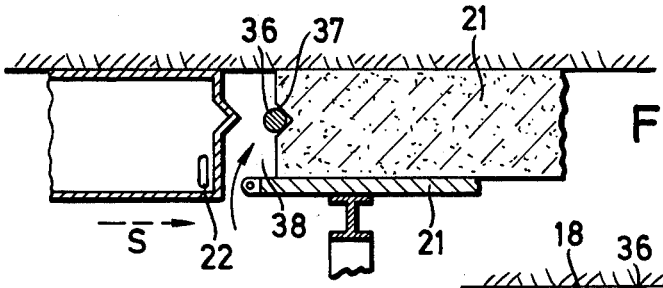

It is possible to introduce a packing 36 between each pair of adjacent annular sections. FIGS. 5 to 7 show the various stages of carrying out the positioning of such a packing 36. FIG. 5 shows the position in which all the knives 10 have been advanced so that their surfaces 27 are situated in a common plane. The projections 28 at the end of the box-shaped portions form a groove 37 in the annular end surface of the concrete section just-formed. In order to position the packing 36 in this groove 37, the pivot joints 22 between the knives 10 and the shuttering elements 21 are released (see FIG. 6), and the knives advanced relative to their shuttering elements (see FIG. 7) by a distance large enough to ensure that a sufficiently large gap 38 exists for the introduction of the packing 36. The packing 36 forms a key which helps to bond the next concrete lining section to this section. The rear end of each knife 10 may be provided with a short tail plate (not shown) which can either be non-displaceably connected with the rear end of the knife, or made displaceable in relation to the knife in the direction shown by the arrow S. These tail plates cover the mouth of the gap 38, which is important in friable ground as they prevent material falling into the working zone within the shield. In either case, the knife 10 can be retracted in order to restore the pivot joint 22.

Figure 8:
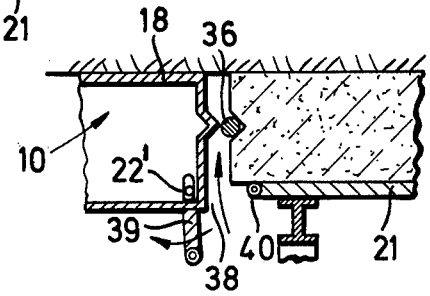

In accordance with FIG. 8 it is also possible to insert, between each shuttering element 21 and its knife 10, an intermediate link 39 which is pivotally connected to the knife via a pivot joint 22', and with the shuttering element via a detachable joint 40. In order to provide a gap 38 for the introduction of the packing 36, the knives 10, and the shuttering elements 21 connected thereto by means of the links 39, are advanced to the extent required to form the gap 38 for the introduction of the packing 36. The joints 40 are then released, so that the packing 36 can be inserted into the annular groove 37. The joint connections 40 are then restored, after which the tunnelling and concreting work, as described above, is resumed.

Figure 9:
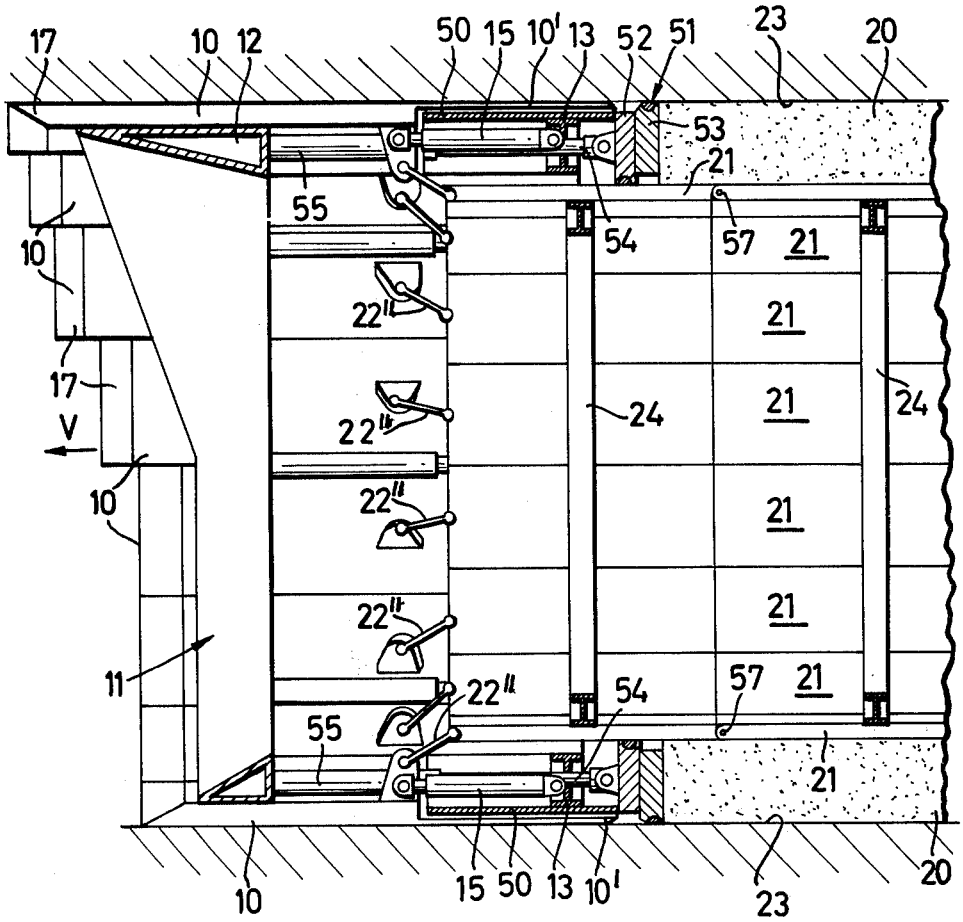
FIG. 9 is a longitudinal cross-section through the second form of apparatus.
Figure 10:
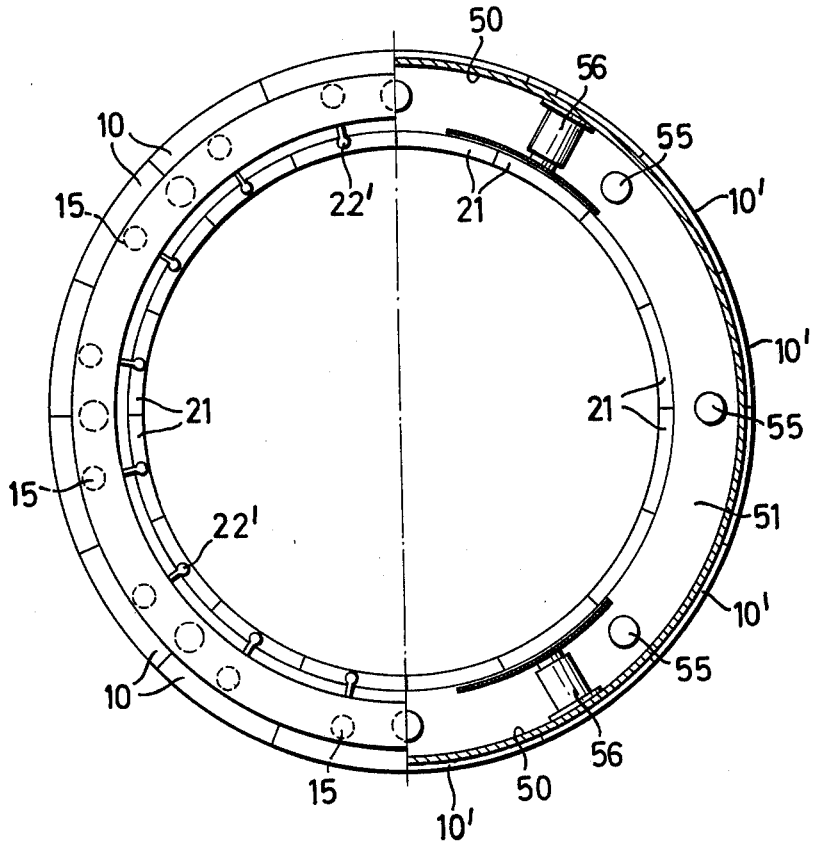
FIG. 10 shows the apparatus of FIG. 9 as seen from the rear (on the left of FIG. 10) and in cross-section (on the right of FIG. 100.

FIGS. 9 and 10 show a modified form of apparatus in which each of the individual drifting knives 10 is provided, with a tail extension 10'. The tail extensions 10' are constituted by curved sheet metal plates which collectively form, at the rear end of the knife shield, a cylindrical tail casing which accommodates a follow-up shield 50 whose length approximately corresponds to that of the tail casing. The follow-up shield 50 is displaceably supported by frame section 13 of the support frame 11. An end shuttering 51 is connected to the follow-up shield 50, the end shuttering being constituted by two rings 52 and 53. The ring 52 is fixed to the rear end of the follow-up shield 50, while the other ring 53 is slidably supported by the ring 52 in such a way that the two rings can be adjusted to different radial dimensions of the annular space between the shuttering elements 21 and the tunnel wall 23. The piston rods 54 of hydraulic rams 55 act on the ring 52, and their cylindeers abut the support frame section 12. Thus, the end shuttering 51, together with the follow-up shield 50, is adjustable relative to the support frame 11 in the tunnelling direction, and also in the opposite direction.

The shuttering elements 21 are connected, by universal joints, to their knives 10. Each such connection is effected by means of a link 22" which is detachably connected by a ball-and-socket joint with both its knife 10 and its shuttering element 21. The shuttering elements 21 can therefore be disconnected from their knives 10. Here again, the shuttering elements 21 form a cylindrical inner shuttering, and are supported and automatically guided on movable props 24.

The advance of the knife shield is carried out in the manner described above with reference to FIGS. 1 to 8, the knives 10 being advanced individually or in groups, and the support frame 11 then being moved up into position. As the knives 10 are advanced, their tail extensions 10' slide over the follow-up shield 50, which is held stationary by the rear support frame section 13, and which secures the cross-section of the tunnel in the zone between the knife shield and the concrete lining 20 already completed. When the support frame 11 is moved up into position, the support frame section 13 slides inside the cylindrical follow-up shield 50. During this process, the hydraulic rams 55 thrust shuttering 51 to the rear end, and thus maintain the required pressure on the concrete introduced into the annular space between the shuttering elements 21 and the tunnel wall 23. It is also possible, however, for the end shuttering 51 to be advanced together with the support frame 11. In both cases it is important for the advance movement of the end shuttering 51 to be determined by the pressure of the concrete inside the annular space. As the end shuttering 51 is advanced, therefore, concrete is introduced into the annular space in such a way that this space is continuously filled with concrete. Here again, the concrete can be fed in via one or more feed pipes (not shown, but similar to the pipes 29) which pass through the end shuttering 51.

Owing to the universal joints 22" between the knives 10 and their shuttering elements 21, and also because of the adjustability of the end shuttering 51, controlability of the knife shield is ensured. It is also possible for the cylindrical inner shuttering formed by the shuttering elements 21 to be aligned accurately with respect to the axis of the tunnel. This can be done by means of adjusting or regulating devices, such as hydraulic adjusting rams 56, which are positioned radially, as shown in FIG. 10, between the follow-up shield 50 and the shuttering elements 21. For reasons of clarity, these items are not shown in FIG. 9.

It is possible to disconnect the shuttering elements 21 from their knives 10, this being done by releasing the links 22". Moreover, each of the shuttering elements 21 is subdivided by an intermediate joint 57. Thus, after the disconnection of the shuttering elements 21 from their knives 10, and the removal of the relevant prop 24, the front parts of the shuttering elements can be turned over inwards about the joints 57. Then, by using the rams 55, the end shuttering 51 can be advanced slightly away from the end surface of the concrete lining 20, so that packing (not shown, but similar to the packing 36 of the embodiment of FIGS. 1 to 8) can be introduced between the end shuttering and the concrete lining.

It will be apparent that in the tunnel lining process described above, the concreting is effected without the use of an outer shuttering. It will also be apparent that the apparatus and process could be modified. Thus, the concrete could be fed through the pipes 29 as dry concrete, in which case water and a rapid binding agent would be added separately. It may also be advisable to compress the concrete by a vibrating process, in which case suitable vibrators would be provided on the knives 10. Moreover, the reinforcement elements 31 can be introduced continuously in the course of the concreting work.

We claim:

1. A method of driving and lining tunnels, the method comprising the steps of driving a tunnel by means of a knife shield, and forming a concrete lining in the tunnel behind the knife shield, the lining being formed in sections along the tunnel, wherein each lining section is formed by introducing concrete into an annular space formed between a shuttering and the tunnel wall, the shuttering being constituted by a plurality of elongate shuttering elements, each of which may be advanced independently of the others and each of which is connected to a respective knife of the knife shield for conjoint advance movement therewith, and wherein the advance of a shuttering element is accompanied by the step of forcing concrete into the space between that shuttering element and the tunnel wall.

2. A method according to claim 1, wherein the concrete is introduced into each said space through the respective knife of the knife shield.

3. A method according to claim 1, wherein reinforcement elements are introduced into each said space through the respective knife.

4. A method according to claim 1, wherein each shuttering element is detachably connected to its knife, and wherein after each lining section is completed, the shuttering elements are detached from their knives, the knives are advanced slightly to expose the annular end surface of that lining section, packing is positioned around said annular end surface, and the shuttering elements are re-attached to their knives.

5. A method according to claim 4, wherein a groove is formed in said annular end surface and the packing is positioned in this groove.

6. In a method of driving and lining tunnels, the method comprising the steps of driving a tunnel by means of a knife shield, and forming a concrete lining in the tunnel behind the knife shield, the lining being formed in sections along the tunnel, the improvements comprising forming each lining section by introducing concrete into an annular space formed between an inner shuttering and the tunnel wall, and constituting the shuttering by a plurality of elongate shuttering elements, each of which may be advanced independently of the others and each of which is connected to a respective knife of the knife shield for conjoint advance movement therewith, the advance of a shuttering element being accompanied by the step of forcing concrete into the space between that shuttering element and the tunnel wall.

7. Apparatus for driving and lining tunnels, the apparatus comprising a knife shield for driving the tunnel, said knife shield having a plurality of knives mounted on a support frame, each of the knives being advanceable relative to the support frame by means of a respective hydraulic ram, and a shuttering positioned behind the knife shield for supporting a tunnel lining section whilst the concrete forming that section sets, the shuttering being inwardly off-set, in use, from the tunnel wall to define an annular space, wherein the shuttering is constituted by a plurality of elongate shuttering elements each of which may be advanced independently of the others and each of which is connected to a respective knife for conjoint advance movement therewith, and means for forcing concrete into the annular space between the advancing shuttering elements and the tunnel wall.

8. Apparatus according to claim 7 wherein an annular end shuttering is provided for closing the front end of said annular space.

9. Apparatus according to claim 8, wherein the annular end shuttering is constituted by the rear end faces of the knives.

10. Apparatus according to claim 8, wherein each shuttering element is detachably connected to its respective knife.

11. Apparatus according to claim 8, wherein each shuttering element is pivotally connected to its respective knife.

12. Apparatus according to claim 8, wherein each shuttering element is connected to its respective knife by means for permitting the distance of that shuttering element from the tunnel wall to be adjusted.

13. Apparatus according to claim 8, wherein each shuttering element is connected to its respective knife by means of a connecting plate.

14. Apparatus according to claim 8, wherein each shuttering element is connected to its respective knife by means of a link, the link being joined to the shuttering element and to the knife by respective ball-and-socket joints.

15. Apparatus according to claim 8, wherein each of the knives is provided with a tail extension which extends rearwardly of the point of connection with the respective shuttering elements, the tail extensions resting, in use, against the tunnel wall and being supported by a follow-up shield.

16. Apparatus according to claim 15, wherein an annular end shuttering is provided on the follow-up shield, the annular end shuttering closing the front end of said annular space.

17. Apparatus according to claim 16, wherein the end shuttering is rigidly connected to the follow-up shield, and the follow-up shield is coupled to the support frame of the knife shield by means of hydraulic rams.

18. Apparatus according to claim 17, wherein the support frame has frame sections which support the knives and the follow-up shield respectively.

19. Apparatus according to claim 15, wherein means are provided for aligning the shuttering.

20. Apparatus according to claim 19, wherein said alignment means is constituted by a plurality of radially directed hydraulicalic rams each of which is positioned between a respective shuttering element and the follow-up shield.

21. Apparatus according to claim 15, wherein the tail extensions of the knives overlap the follow-up shield by a maximum distance which is greater than the length of the working stroke the hydraulic advance rams.

22. Apparatus according to claim 15, wherein each of the shuttering elements has a greater length than it respective tail extension.

23. Apparatus according to claim 16, wherein the end shuttering is constituted by two rings, one of which is fixed to the follow-up shield and the other of which is radially adjustable.

24. Apparatus according to claim 15, wherein each of the shuttering elements is constituted by two elongate members pivotally joined together.

25. In apparatus for driving and lining tunnels, the apparatus comprising a knife shield for driving the tunnel, and a shuttering positioned behind the knife shield for supporting a tunnel lining section whilst the concrete forming that section sets, the knife shield having a plurality of knives mounted on a support frame, and each of the knives being advanceable relative to the support frame by hydraulic ram means, the improvements comprising positioning the shuttering so as to be inwardly off-set, in use, from the tunnel wall to define an annular space, and constituting the shuttering by a plurality of elongate shuttering elements each of which is connected to respective one of said knives for conjoint advance movement therewith, and means for forcing concrete into the annular space between the advancing shuttering elements and the tunnel wall.

* * * * *